US008701840B2

(12) United States Patent
Allen

(10) Patent No.: US 8,701,840 B2
(45) Date of Patent: Apr. 22, 2014

(54) SELF-BELAY DEVICE FOR CLIMBERS

(76) Inventor: Samantha Allen, Yardley, PA (US)

( * ) Notice: Subject to any disclaimer, the term of this patent is extended or adjusted under 35 U.S.C. 154(b) by 113 days.

(21) Appl. No.: 13/338,033

(22) Filed: Dec. 27, 2011

(65) Prior Publication Data

US 2013/0161133 A1 Jun. 27, 2013

(51) Int. Cl.
*B65H 59/16* (2006.01)

(52) U.S. Cl.
USPC ..... 188/65.1; 182/5

(58) Field of Classification Search
USPC ..... 182/5, 6, 192, 193; 188/65.1–65.5
See application file for complete search history.

(56) References Cited

U.S. PATENT DOCUMENTS 4,729,456 A * 3/1988 Sugiyama ..... 188/65.1
5,217,092 A * 6/1993 Potter ..... 188/65.4
6,029,777 A * 2/2000 Rogelja ..... 182/193
6,899,203 B1 * 5/2005 Golden et al. ..... 188/65.4
8,100,231 B2 * 1/2012 Petzl et al. ..... 188/65.5
8,167,086 B1 * 5/2012 Brendley et al. ..... 182/5
8,348,016 B2 * 1/2013 Lewis et al. ..... 182/192
2011/0073417 A1 * 3/2011 Chaumontet et al. ..... 188/65.5
2012/0193166 A1 * 8/2012 Rogelja ..... 182/5

* cited by examiner

*Primary Examiner* — Christopher Schwartz
(74) *Attorney, Agent, or Firm* — Berenato & White, LLC

(57) ABSTRACT

A self-belay device for controlling climbing and descending along a rope. The self-belay device comprises a hollow casing, a linear frictionless track fixed inside the casing and a braking unit disposed in the casing and mounted on the track for reciprocating sliding movement along the track between a first position and a second position. The braking unit is normally biased to the first position. The braking unit has a passage there through for passing of the rope. The rope is moveable through the passage in the braking unit in the first position, while the movement of the rope through the passage in the braking unit prevented in the second position thereof.

17 Claims, 3 Drawing Sheets

SELF-BELAY DEVICE FOR CLIMBERS

BACKGROUNDS OF THE INVENTION

1. Field of the Invention

The present invention relates to the fields of mountain and rock climbing and, more particularly, to a self-belay device for controlling the ascent or descent of a climber.

2. Description of the Related Art

Rock climbing involves the challenge of navigating a rock face which is often essentially vertical. Rock climbing and rappelling have recently become more popular, as have other so-called "extreme" sports. Rock climbing offers individuals an opportunity to be outdoors and participate in an activity that is both rewarding and challenging, while at the same time being non-destructive to the natural environment.

At the start of the climb, the climber will determine the path to be taken as the climber ascends the rock face. The climber will generally need to use his or her entire body as that ascent takes place. Beyond the climber's body, a number of pieces of equipment are generally used by the rock climber. This equipment varies from climbing shoes equipped with tough rubber soles, to sewn harnesses, to a special climbing rope and a belay device, i.e., mechanical climbing equipment used to control a rope during belaying.

The sport of climbing or mountaineering typically requires a team of two people. To ensure the safety of the climber, the climber ties into a rope (i.e. the rope is tied to a harness worn by the climber), and is belayed by a partner, called a belayer. The term "belaying" in the art of the mountain and rock climbing refers to refers to a variety of techniques used in climbing to exert friction on a climbing rope so that a falling climber does not fall very far. While the climber ascends, the belayer takes up or lets out the rope such that the rope is maintained taut between the climber and the belayer, preventing a fall of any great distance by the climber. One type of belay devices, known as "top-roping", employs an anchor placed at the top of the cliff. Typically, the rope runs through this anchor pulley-fashion and the belayer stands at the foot of the cliff, although in some cases the belayer belay from the top. In either case, the anchor is above the climber at all times, so that the climber wilt fall only a short distance if he "falls off" the climb.

Due to the dangers involved climbing, a need exists for belay devices which are reliable and durable for supporting a climber in an emergency situation. The present invention fulfills these needs as described and claimed below.

Lead climbing is when a climber ascends a route and periodically places protection to the rock by placing one end of a quick draw to the rope and the other end to a predrilled anchor or to equipment of their own. During a lead climb the belayer's function is to give the leader slack by feeding the rope out and to stop them during a fail. Lead climbing falls are generally much greater in length than top roping falls because the length of a lead climbing fall is twice the distance between the leader and their last piece of protection, plus any slack in the rope, plus the elongation of the rope. The length of a top roping fall is just the slack in the rope plus the elongation of the rope; this is because the rope is already set in the final anchors at the end of the route. Here the belayer's function is simply to pull the rope in, removing slack between the leader and the top anchors. Solo lead climbing is the same as lead climbing except the belayer is replaced with a solo belay (or self-belay) device.

There are a number of self-belay devices that are available. One is called the "Silent Partner." This device attaches to the climbers harness with two locking carabineers and the rope is attached to it with a clove hitch. As the leader ascends a route, light tension in the rope causes the clove hitch to slip and allows the rope to feed through the device automatically. During a fall, the increased rope rate actuates a centrifugal clutch inside the device which causes the clove hitch to tighten and stops the rope from feeding. To prevent the Silent Partner from stopping their progression the climber must wear the entire rope length on their harness; the rope is tied off in sections and untied a section at a time, giving the climber slack as they need it. The Silent Partner makes falling while solo lead climbing safe but the device is very cumbersome and adds weight to the climber's core.

Another known self-belay device is called the "Soloist." The Soloist has an unconventional set up; the climber attaches the device to their harness with a double fisherman's knot and holds it upright with a chest harness. A directional cam inside the device allows the rope to feed automatically as the climber ascends the route. During a relatively upright fall the cam will pinch on the rope and prevent it from feeding, after a fall the device can leave a climber hanging belly side up in which case they have to get back in an upright position without rocking backwards. If the climber rocks backward the cam can potentially open up and they will free fall. If the climber falls head first the Soloist cannot prevent the rope from feeding and they climber will free fall. White the Soloist retains much of the ease of lead climbing with a human belay, it makes falling very dangerous.

The "Solo-Aid" is another known self-belay device, but is a very restrictive self-belay device. The Solo-Aid ties on to the climber's harness with a double fisherman's knot. A non-directional cam inside the device pinches the rope during all climbing circumstances and prevents the rope from feeding. The climber must manually feed the rope through the device as they ascend a route to compensate for the cam inside the device. During a fall the cam will pinch the rope regardless of the climber's orientation but if tied onto the harness in a sloppy or loose manner, there is a high probability the device will tangle in the climbers other gear or hit them in the face during the fall. The Solo-Aid is not intending for novice climbers; the device makes falling while solo lead climbing relatively safe but essentially forces the climber to ascend a route one handed.

All of the current self-belay devices on the market compromise either safety or ease of climbing. None of the existing self-belay devices even closely resemble lead climbing with a human belay as the climber must wear each device on their harness.

The need, thus, exists for a self-belay device that is safe and closely resembles a lead climbing with a human belayer operating a belay device.

SUMMARY OF THE INVENTION

The present invention is directed to self-belay device for controlling the ascent or descent of a climber along a rope.

The self-belay device of the present invention comprises a hollow casing, a linear frictionless track fixed inside the casing, and a braking unit disposed in the casing and mounted on the track for reciprocating sliding movement along the track between a first position and a second position. The braking unit is normally biased to the first position. The braking unit has a passage there through for passing of the rope. The rope is moveable through the passage in the braking unit in the first position and the movement of the rope through the passage in the braking unit is prevented in the second position thereof.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain the principles of the invention. The objects and advantages of the invention will become apparent from a study of the following specification when viewed in light of the accompanying drawings, wherein.

DETAILED DESCRIPTION OF EXEMPLARY EMBODIMENTS

Figure 1:
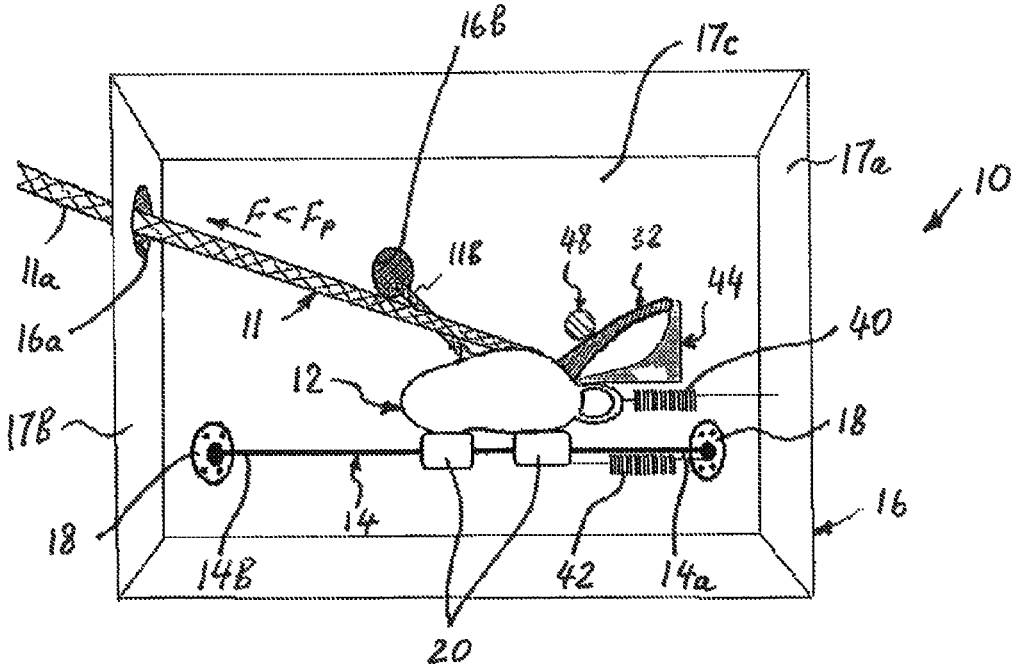
FIG. 1 is an elevational view of a self-belay device according to an exemplary embodiment of the present invention showing a braking unit in a first position thereof.

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in connection with the exemplary embodiments and methods.

This description of exemplary embodiments is intended to be read in connection with the accompanying drawings, which are to be considered part of the entire written description. In the description, relative terms such as "horizontal," "vertical," "left," "right," "top" and "bottom" as well as derivatives thereof (e.g., "horizontally," "leftward," "rightward," etc.) should be construed to refer to the orientation as then described or as shown in the drawing figure under discussion. These relative terms are for convenience of description and normally are not intended to require a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. Additionally, the word "a" as used in the claims means "at least one".

FIGS. 1-4 of the drawings illustrate a self-belay device according to an exemplary embodiment of the present invention, indicated generally by reference numeral, for use in climbing activities and the like. The self-belay device 10 of the present invention is moveable from a released first position to an impeded second position and can be used by climbers and others during any type of climbing activity including, but not limited to, mountaineering, rock climbing, safety descents during emergencies and rescues, etc. In other words, the self-belay device 10 of the present invention is used for controlled descent of a person along a climbing rope 11. Other uses for the belay device 10 are also within the scope of the present invention.

Figure 2:
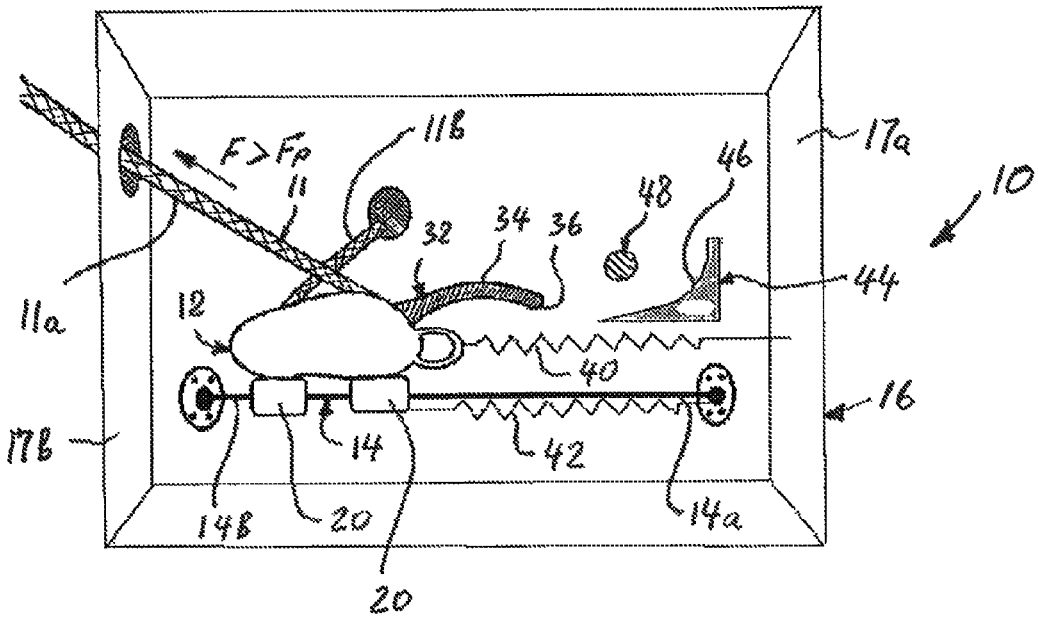
FIG. 2 is an devotional view of the self-belay device according to the exemplary embodiment of the present invention showing the braking unit in a second position thereof.

As illustrated in FIGS. 1 and 2, the self-belay device 10 of the exemplary embodiment of the present invention includes a braking unit 12 mounted on a linear (i.e., straight) frictionless track 14 for reciprocating sliding movement along the track 14 between opposite first and second ends 14*a* and 14*b*, respectively, thereof. Both the braking unit 12 and the linear track 14 are disposed inside a hollow casing 16. As further illustrated in FIGS. 1 and 2, according to the exemplary embodiment of the present invention, the track 14 is fixed (i.e., non-movably mounted) between opposite first and second side walls 17*a* and 17*b*, respectively, of the casing 16 through any appropriate means, such as brackets 18. The braking unit 12 is mounted to the linear track 14 through at least one, but preferably two, sliding carts 20 fixed to the braking unit 12 and slideably mounted to the track 14 for reciprocating sliding movement along the track 14 between a first position adjacent to the first end 14*a* of the track 14 and the first side wall 17*a* of the casing 16, as shown in FIG. 1, and a second position adjacent to the second end 14*b* of the track 14 and the second side wall 17*b* of the casing 16, as shown in FIG. 2. The braking unit 12 is normally biased to the first position. Accordingly, the self-belay device 10 further comprises a first return spring 40 attached to the braking unit 12 at one end and to the first side wall 17*a* of the casing 16 at another end of the return spring 40 for normally biasing the braking unit 12 toward the first position thereof. Additionally, the self-belay device 10 may comprise a second return spring 42 attached to the sliding cart 20 at one end and to the first side wall 17*a* of the casing 16 at another end of the return spring 42 for further biasing the braking unit 12 toward the first position thereof.

Figure 3:
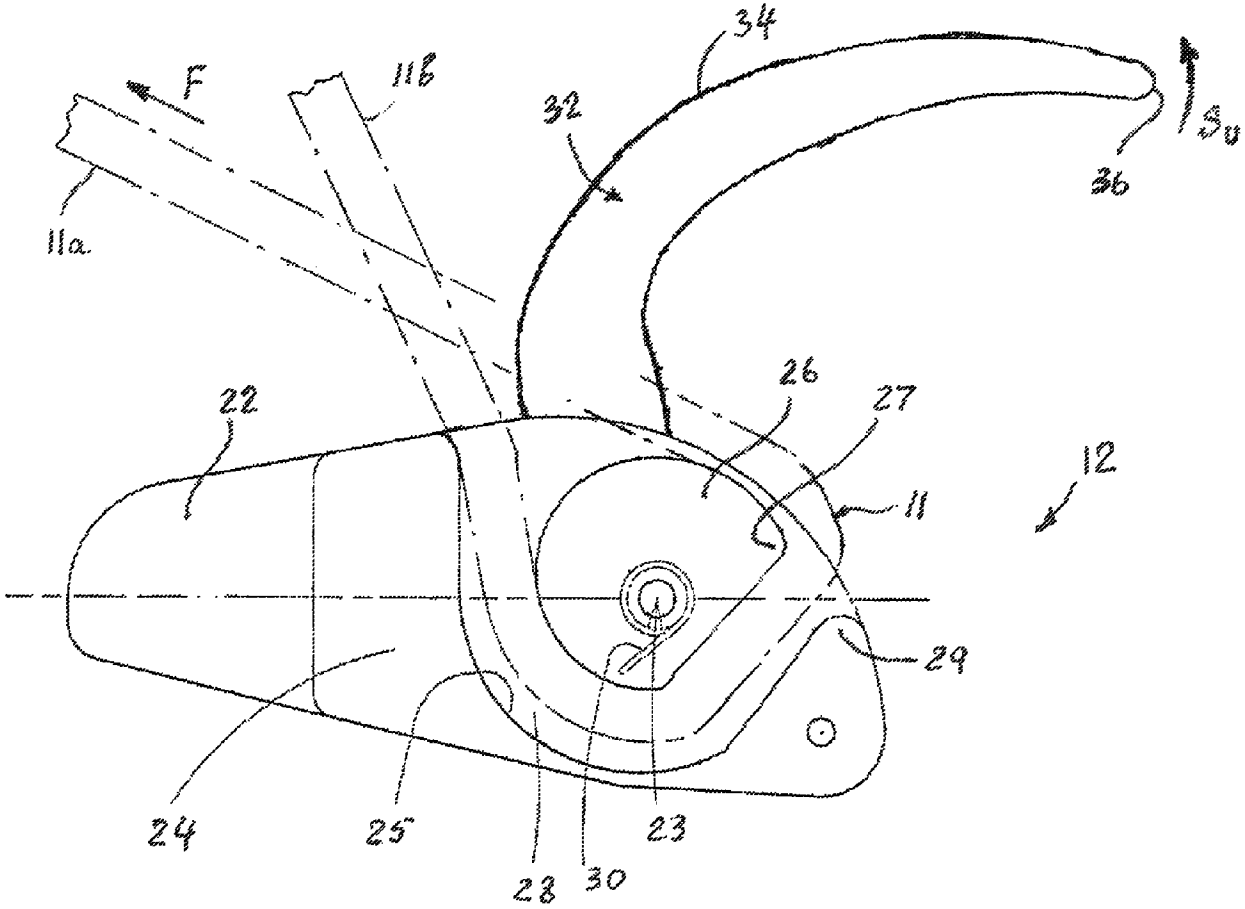
FIG. 3 is an elevational view of the braking unit according to the exemplary embodiment of the present invention in a release position thereof.
Figure 4:
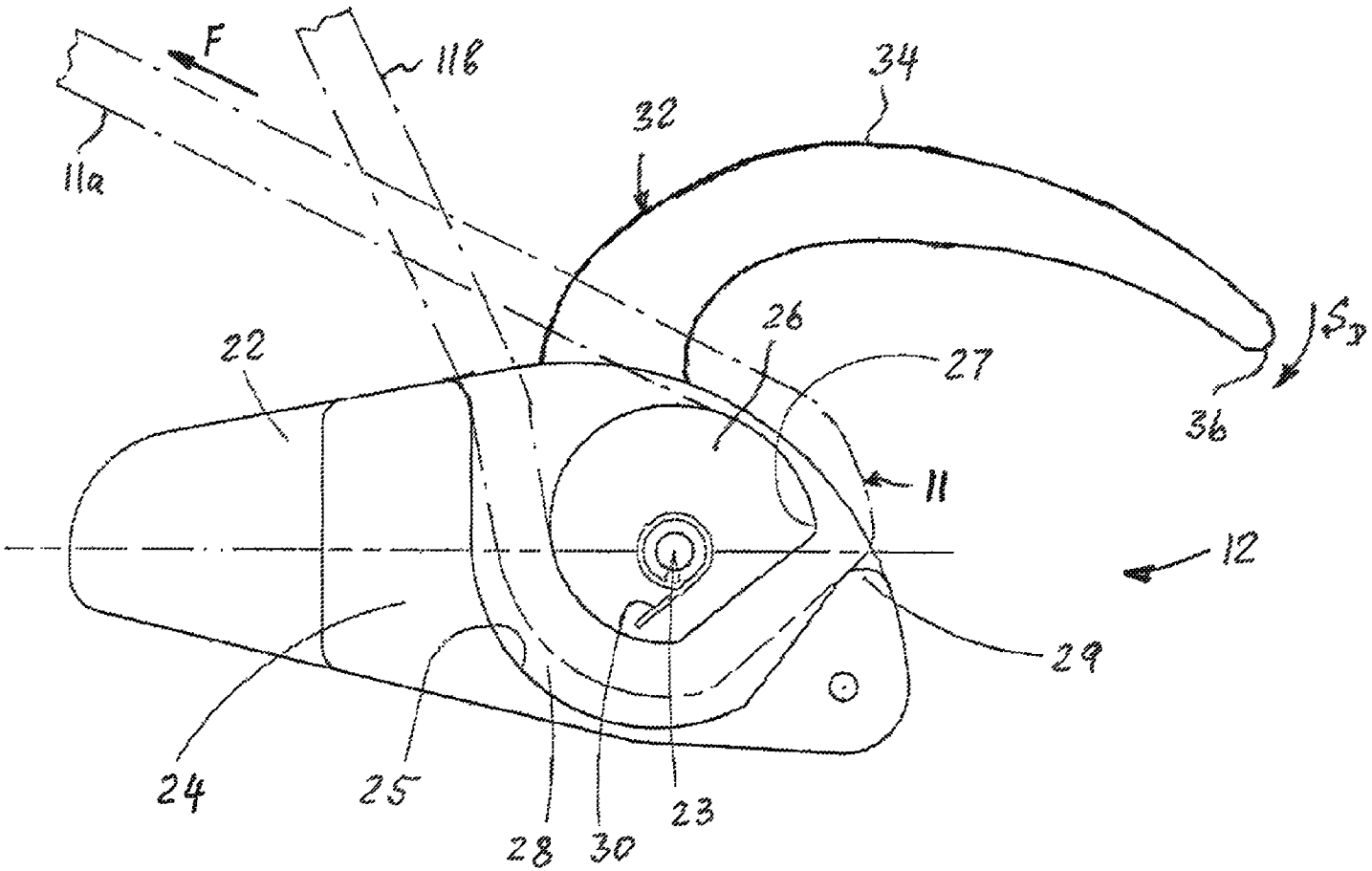
FIG. 4 is an elevational view of the braking unit according to the exemplary embodiment of the present invention in a lock position thereof.

The braking unit 12, as illustrated in detail FIGS. 3 and 4, conventionally includes a base plate 22 having a braking pad 24 fixed to or integrally formed with the base plate 22, and a braking cam 26 mounted to the base plate 22 through a spindle 23 for pivotal movement thereon relative to the base plate 22 between a lock position, shown in FIG. 3, and a release position, shown in FIG. 4. The base plate 22 is fixed to the sliding carts 20. The braking pad 24 includes a curved internal portion 25, substantially centered on the spindle 23 and a braking portion 29 against which the rope 11 is pressed by the locking action of the braking cam 26 in the lock position thereof.

The braking cam 26 is mounted to the base plate 22 so as to be separated from the braking pad 24 by a clearance (or passage) 28 for passage of the climbing rope 11. The braking cam 26 is formed with a cam lobe 27. The rope 11 is adapted to be moveable through the clearance 28 between the braking cam 26 and the braking pad 24 in the release position of the braking cam 26. The movement of the rope 11 is adapted to be restricted through the clearance 28 in the lock position of the braking cam 26 when the tension on the rope 11 rotates the braking cam 26 relative to the braking pad 24 thereby narrowing the clearance 28 between the cam lobe 27 of the braking cam 26 and the braking portion 29 of the braking pad 24, and impeding movement of the rope 11 through the clearance 28. It will be appreciated that the braking cam 26 and the braking pad 24 may be of a variety of different shapes and configurations.

The braking unit 12 also includes a biasing spring 30 normally biasing the braking cam 26 to the lock position thereof so as to return the braking cam 26 to the lock position from said release position. According to an exemplary embodiment of the present invention shown in FIG. 3, the return spring is in the form of a torsion type spring arranged on the spindle 23.

The braking unit 12 further includes a pivoting control lever 32 having a curved (convex) work surface 34 and a rounded distal end 36. The control lever 32 is operatively coupled, for example, fixedly attached, to the braking cam 26 so that pivotal movement of the control lever 32 causes the corresponding pivotal movement of the braking cam 26. Accordingly, release of the control lever 32 causes the downward pivotal movement (as shown in FIG. 4) of the control lever 32 in the direction of the arrow $S_D$ and the rotation of the braking cam 26 to the lock position due to the biasing action of the biasing spring 30. On the contrary, the upward pivotal movement (as shown in FIG. 3) of the control lever 32 in the direction of the arrow $S_U$ causes the rotation of the braking cam 26 to the release position against the tension of the return spring 30. Hence, both the braking cam 26 and the control lever 32 are simultaneously pivotally moveable between the lock position due to the biasing force of the biasing spring 30, shown in FIG. 4, and the release position, shown in FIG. 3.

The rope 11 has an upstream part hooked onto an anchoring device (not shown) fixed to wall or rock above the self-belay device 10, and a free ended downstream part 11*b*. As illustrated in FIGS. 1 and 2, inside the casing 16 of the self-belay device 10, the rope 11 is wound around the t braking cam 26 of the braking unit 12, The upstream part 11*a* of the rope 11 enters the casing 16 through a first hole 16*a* in the second side wall 17*b* of the casing 16, passes around the braking cam 26 of the braking unit 12 and exits through a second hole 16*b* in a rear wall 17*c* of the casing 16.

The self-belay device 10 of the exemplary embodiment of the present invention further comprises a wedge member 44 disposed inside the casing 16 and fixedly attached thereto. The wedge member 44 has an actuating surface 46 provided to slideably cooperate with a distal end 36 of said control lever 32. The actuating surface 46 of the wedge member 44 of the exemplary embodiment of the present invention is in the form of a curved (concave) surface. Alternatively, the actuating surface 46 of the wedge member 44 can be in the form of a planar (flat) surface oriented at an oblique angle relative to the track 14. The self-belay device 10 of the exemplary embodiment of the present invention also comprises a hinge pin 48 slideably cooperating with the curved work surface 34 of the control lever 32. The hinge pin 48 is fixedly attached to the casing 16.

In operation, when the tension F of the rope is lower than a preset threshold $F_P$, the braking unit 12 is moved rightward along the track 14 toward the first end 14*a* of the track 14 toward the first position, as illustrated in FIG. 1, due to the biasing force of the return springs 40 and 42. The rightward displacement of the braking unit 12 causes the rounded distal end 36 of the control lever 32 to engage the actuating surface 46 of the wedge member 44. As the control lever 32 of the braking unit 12 moves further rightward, the upward sliding movement of the rounded distal end 36 of the control lever 32 over concave the actuating surface 46 of the wedge member 44 causes the upward pivotal movement of the control lever 32 in the direction of the arrow $S_U$ (as shown in FIG. 3). In turn, the upward pivotal movement of the control lever 32 causes the rotation of the braking cam 26 to the release position against the tension of the return spring 30. In this (first) position, as noted above, the braking cam 26 is in the release position against the tension of the return spring 30 and the rope 11 is free to move through the self-belay device 10. As illustrated in FIG. 3, the cam lobe 27 of the braking cam 26 and the braking portion 29 of the braking pad 24 are sufficiently separated, widening the clearance 28, allowing the rope 11 to move freely through the braking unit 12 of the self-belay device 10.

In the course of a descent along the rope 11, the tension F on the rope 11 is normally less than the preset threshold $F_P$. Accordingly, the braking unit 12 is normally biased to the first position by the biasing force of the return springs 40 and 42. If the climber attached to the rope 11 falls, then a weight of the falling climber abruptly pulls the upstream part 11*a* of the rope 11. The upward pull rope 11 produces the tension F on the upstream part 11*a* of the rope 11, which is more than the preset threshold $F_P$. Subsequently, the braking unit 12 is moved leftward along the track 14 toward the second end 14*b* of the track 14 toward the second position thereof, as illustrated in FIG. 2, against the biasing force of the return springs 40 and 42.

The leftward movement of the braking unit 12 causes the rounded distal end 36 of the control lever 32 to disengage from the actuating surface 46 of the wedge member 44. As the control lever 32 of the braking unit 12 moves leftward, the downward sliding movement of the rounded distal end 36 of the control lever 32 over concave the actuating surface 46 of the wedge member 44 causes the downward pivotal movement of the control lever 32 in the direction of the arrow $S_D$ (as shown in FIG. 4). In turn, the downward pivotal movement of the control lever 32 causes the rotation of the braking cam 26 to the lock position due to the tension of the return spring 30. When the control lever 32 is disengaged from wedge member 44, both the control lever 32 and the braking cam 26 of the braking unit 12 are pivotally moved to the lock position due to the tension of the return spring 30, and the braking unit 12 is moved to the second position by the tension F on the upstream part 11*a* of the rope 11 against the biasing force of the return springs 40 and 42.

In this (second) position shown in FIG. 2, as noted above, the braking cam 26 is in the lock position against the tension of the return spring 30 and the rope 11 is prevented to move through the self-belay device 10. As illustrated in FIG. 4, the cam lobe 27 of the braking cam 26 and the braking portion 29 of the braking pad 24 are sufficiently close to each other, narrowing the clearance 28, to prevent the rope 11 to move through the braking unit 12 of the self-belay device 10. Accordingly, a fall of the climber by any great distance is prevented.

The foregoing description of the preferred embodiment of the present invention has been presented for the purpose of illustration in accordance with the provisions of the Patent Statutes. It is not intended to be exhaustive or to limit the invention to the precise forms disclosed. Obvious modifications or variations are possible light of the above teachings. The embodiment disclosed hereinabove was chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A self-belay device for climbing and descending along a rope, said self-belay device comprising:

a hollow casing;

a linear track fixed inside said casing; and a braking unit disposed in said casing and mounted on said track for reciprocating sliding movement along said track between a first position and a second position, said braking unit normally biased to said first position;

said braking unit having a passage there through for passing of the rope;

the rope moveable through said passage in said braking unit in said first position and the movement of the rope through said passage in said braking unit prevented in said second position thereof.

2. The self-belay device as defined in claim 1, wherein said braking unit is moved to said first position when the tension of the rope is lower than a preset threshold.

3. The self-belay device as defined in claim 2, wherein said braking unit is moved to said second position when the tension of the rope is higher than the preset threshold.

4. The self-belay device as defined in claim 1, further comprising a return spring normally biasing said braking unit to said first position.

5. A self-belay device for climbing and descending along a rope, said self-belay device comprising:

a hollow casing;

a linear track fixed inside said casing; and a braking unit disposed in said casing and mounted on said track for reciprocating sliding movement along said track between a first position and a second position said braking unit normally biased to said first position;

said braking unit having a passage there through for passing of the rope;

the rope moveable through said passage in said braking unit in said first position and the movement of the rope through said passage in said braking unit prevented in said second position thereof;

said braking unit including:

a base plate having a braking pad; and a braking cam mounted to said base plate for pivotal movement between a lock position and a release position, said braking cam separated from said braking pad by a clearance defining said passage in said braking unit;

the rope moveable through the clearance in said release position of said braking cam and the movement of the rope through the clearance prevented in said lock position of said braking cam;

said braking cam pivotally moved to said release position in said first position of said braking unit;

said braking cam pivotally moved to said lock position in said second position of said braking unit due to biasing force of said biasing spring of said braking cam.

6. The self-belay device as defined in claim 5, wherein said braking unit further comprises a biasing spring normally biasing said braking cam to said lock position.

7. The self-belay device as defined in claim 5, wherein said braking unit further comprises a control lever pivotally mounted to said base plate, said control lever is operatively coupled to said braking cam so that pivotal movement of said control lever causes the corresponding pivotal movement of said braking cam; both said braking cam and said control lever are pivotally moveable between said lock position and said release position.

8. The self-belay device as defined in claim 7, wherein said braking unit further comprises a biasing spring normally biasing said braking cam and said control lever to said lock position.

9. The self-belay device as defined in claim 8, further comprising a wedge member disposed inside said casing and fixedly attached thereto; said wedge member has an actuating surface provided to slideably cooperate with a distal end of said control lever.

10. The self-belay device as defined in claim 9, wherein said distal end of said control lever engages said actuating surface of said wedge member in said first position of said braking unit so as to pivotally move both said braking cam and said control lever to said release position; and wherein said distal end of said control lever is disengaged and spaced from said actuating surface of said wedge member in said second position of said braking unit so as to pivotally move both said braking cam and said control lever to said lock position due to biasing force of said biasing spring of said braking cam.

11. The self-belay device as defined in claim 9, wherein said actuating surface 46 of the wedge member 44 is in the form of one of a curved surface and a planar surface oriented at an oblique angle relative to said track.

12. The self-belay device as defined in claim 11, wherein said curved surface of said wedge member is concave.

13. The self-belay device as defined in claim 9, wherein said distal end of said control lever is rounded.

14. The self-belay device as defined in claim 9, further comprising a hinge pin fixedly attached to said casing and provided to slideably cooperate with a work surface of said control lever.

15. The self-belay device as defined in claim 14, wherein said work surface of said control lever is in the form of a curved surface.

16. The self-belay device as defined in claim 15, wherein said curved surface of said control lever is convex.

17. A self-belay device for climbing and descending along a rope, said self-belay device comprising:

a hollow casing;

a linear track fixed inside said casing;

a braking unit disposed in said casing and mounted on said track for reciprocating sliding movement along said track between a first position when the tension of the rope is lower than a preset threshold and a second position when the tension of the rope is higher than the preset threshold;

a spring biasing said braking unit to said first position; and a wedge member disposed inside said casing and fixedly attached thereto;

said braking unit including:

a base plate having a braking pad;

a braking cam mounted to said base plate for pivotal movement between a lock position and a release position, said braking cam separated from said braking pad by a clearance defining a passage for passage of the rope;

a control lever pivotally mounted to said base plate and having a distal end, said control lever operatively coupled to said braking cam so that pivotal movement of said control lever causing the corresponding pivotal movement of said braking cam;

both said braking cam and said control lever pivotally moveable between a lock position and a release position; and a biasing spring biasing said braking cam and said control lever to said lock position;

the rope moveable through the clearance in said release position of said braking cam and the movement of the rope through the clearance prevented in said lock position of said braking cam;

said wedge member having an actuating surface provided to slideably cooperate with said distal end of said control lever;

said distal end of said control lever engaging said actuating surface of said wedge member in said first position of said braking unit so as to pivotally move both said braking cam and said control lever to said release position;

said distal end of said control lever disengaged and spaced from said actuating surface of said wedge member in said second position of said braking unit so as to pivotally move both said braking cam and said control lever to said lock position due to biasing force of said biasing spring of said braking cam.

* * * * *